United States Patent [19]

Wollman

[11] Patent Number: 4,825,427

[45] Date of Patent: Apr. 25, 1989

[54] WRIST WATCH CASE AND BRACELET ASSEMBLY

[75] Inventor: Jack Wollman, Manhasset, N.Y.

[73] Assignee: Bulova Watch Co., Inc., Woodside, N.Y.

[21] Appl. No.: 185,851

[22] Filed: Apr. 25, 1988

[51] Int. Cl.[4] ..... G04B 5/02

[52] U.S. Cl. ..... 368/282; 368/281; 368/88; 368/309

[58] Field of Search ..... 368/276, 281, 282, 88, 368/308–310

[56] References Cited

U.S. PATENT DOCUMENTS

| | | | |
|---|---|---|---|
| 1,629,040 | 5/1927 | McGrevy | 368/281 |
| 4,396,298 | 2/1983 | Ripley | 368/282 |
| 4,624,581 | 11/1986 | Mock et al. | 368/282 |

*Primary Examiner*—Bernard Roskoski
*Attorney, Agent, or Firm*—Michael Ebert

[57] ABSTRACT

A wrist watch and bracelet assembly in which the case is of bipartite construction and is formed by a base section adapted to accommodate a watch movement and an ornamental face section that is readily replaceable by a face section having a different ornamental display, whereby the decorative appearance of the watch may readily be changed. The base section is provided at either end with a pair of pierced ears that project forwardly from the corners, while the face section which is seated on the base section is provided at either end with an array of equi-spaced lugs having holes therein which register with those in the ears so that by inserting a cross pin through the holes to bridge the ears and the lugs, the two sections are then interlocked. Each component of the bracelet terminates by a tail formed by an array of equi-spaced links which intermesh with the related lugs of the face section, the links having holes therein which register with those of the lugs, whereby the inserted pin also functions to pivotally join each bracelet component to the watch case.

7 Claims, 2 Drawing Sheets

WRIST WATCH CASE AND BRACELET ASSEMBLY

BACKGROUND OF INVENTION

1. Field of Invention

This invention relates to wrist watch case and bracelet assemblies, and more particularly to an assembly whose bipartite case includes an ornamental face section which is readily replaceable by a face section having a different ornamental display.

2. Status of Prior Art:

In a conventional modern wrist watches, the timekeeping movement is housed within a metal case provided with a pair of projecting ears at either end. Each pair of ears is bridged by a retractable cross bar having spring-biased pins or pintles extending axially therefrom to be received within small cavities formed in the ears. The watch strap or bracelet associated with the case may be fabricated of leather, plastic, metal links or other material conformable to the wrist, the strap being constituted by two complementary components whose adjacent ends terminate in a buckle, a clasp or other means to join the components together at a position appropriate to the size of the wearer's wrist. The other ends or tails of the strap components are in a looped formation or are provided with a fixture having a transverse bore to admit the cross bar, thereby linking the components to the case.

Most modern watches, whether of the digital or analog type, have a quartz crystal-controlled timekeeping movement. A quartz watch in the 5 to 10 thousand dollar price range does not include a quartz movement which is significantly more expensive than the quartz watch in the 100 to 200 dollar price range. The difference in price depends largely on the quality of the watch case and its associated bracelet; and if, for example, these are made of solid gold rather than of stainless steel or synthetic plastic, the wrist watch will be very expensive; and even more so if the case is encrusted with gems.

A watch is worn at all times to keep its wearer abreast of the time. But different occasions in the course of the day may dictate a watch appropriate to the occasion. Thus, a woman wearing a designer gown and costly jewelry who attends a formal affair or the opera will wish to wear and ornamental watch suitable to this occasion, rather than a watch having a utilitarian appearance.

This same woman may be a high-level executive or professional of some sort, and during business hours will normally wear a conservative, relatively unadorned watch, but this watch would be inappropriate to a festive occasion. Thus, a woman of this class will usually possess several watches; and while they are more or less expensive, they differ markedly in appearance; for each watch is designed for an appropriate activity.

What is true for women also applies to male wearers of wrist watches; for a watch design appropriate to working hours may be unsuitable for after hours activities. Thus, a fine watch having a stainless steel case and a stainless steel bracelet, while suitable during business hours, does not afford the kind of impression the man may wish to make at a dinner party or when attending a sports event.

It is for this reason that both men and women who seek to be fashionable and presentable at all times find it necessary to purchase several watches, all of which have excellent movements but differ in their ornamental appearance. In this way, the wearer can, when the occasion arises, switch from a relatively unadorned watch to one highly adorned and therefore more impressive or fashionable.

The problem with being in possession of several watches, apart from the high cost of ownership, is that each watch has to be maintained in working order. When the watches are battery powered, as in the case of modern watches having quartz movements, the life of the miniature battery or batteries varies from watch to watch. The wearer may find that when the need arises to switch from one watch to another, the watch he now wishes to wear may not be in operating condition.

Another factor that comes into play when wearing a watch is personal security. One who wears an expensive-looking watch having a gold case and bracelet or one adorned with gems is an obvious target to muggers. While the wearer may wish to wear this watch on special occasions under secure conditions, he would be ill-advised to wear this watch on the streets of the typical American city.

SUMMARY OF INVENTION

In view of the foregoing, the main object of this invention is to provide a wrist watch case and bracelet assembly in which the bipartite case for the movement includes a face section which is readily replaceable by a face section having a different ornamental display.

A significant advantage of the invention is that it obviates the need to own several watches which differ in ornamental appearance, for the same watch having a high quality movement can readily be transformed in appearance, to render it suitable for a given occasion.

Also an advantage of the invention is that it is only necessary to maintain a single watch movement in working order even though the wearer, in effect, has available for use watches which differ significantly in appearance.

Yet another advantage of the invention is that the watch, for reasons of personal security, can be given a plain, inexpensive appearance.

More particularly, an object of the invention is to provide an assembly of the above type which makes it possible to readily replace not only the face section of the watch case but also the bracelet associated therewith. Thus, if the wearer replaces a stainless steel face section of the case with a solid gold face section, he can at the same time replace a stainless steel bracelet with a solid gold bracelet.

Briefly stated, these objects are attained in a wrist watch and bracelet assembly in which the case is of bipartite construction and is formed by a base section adapted to accommodate a watch movement and an ornamental face section that is readily replaceable by a face section having a different ornamental display, whereby the decorative appearance of the watch may readily be changed. The base section is provided at either end with a pair of pierced ears that project forwardly from the corners, while the face section which is seated on the base section is provided at either end with an array of equispaced lugs having holes therein which register with those in the ears so that by inserting a cross pin through holes to bridge the ears and the lugs, the two sections are then interlocked. Each component of the bracelet terminates by a tail formed by an array of equi-spaced links which intermesh with the related lugs of the face section, the links having holes therein which register with those of the lugs, whereby the inserted pin also functions to pivotally join each bracelet component to the watch case.

BRIEF DESCRIPTION OF DRAWINGS

For a better understanding of the invention as well as other objects and further features thereof, reference is made to the following detailed description to be read in conjunction with the accompanying drawings, wherein.

DESCRIPTION OF INVENTION

Figure 1:
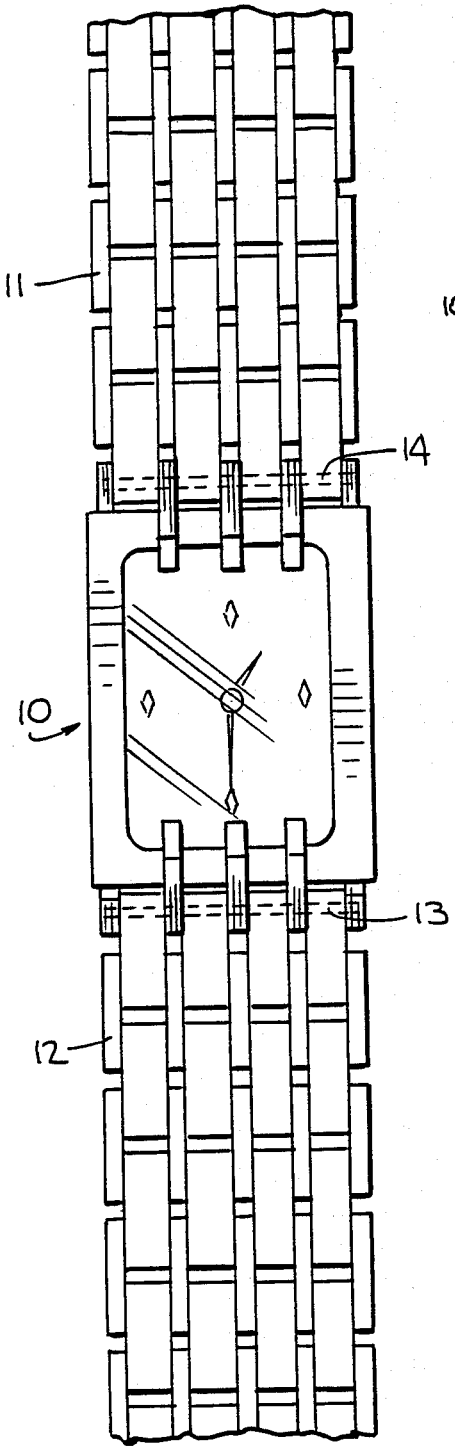
FIG. 1 is a top view of a wrist watch case and bracelet assembly in accordance with the invention.
Figure 2:
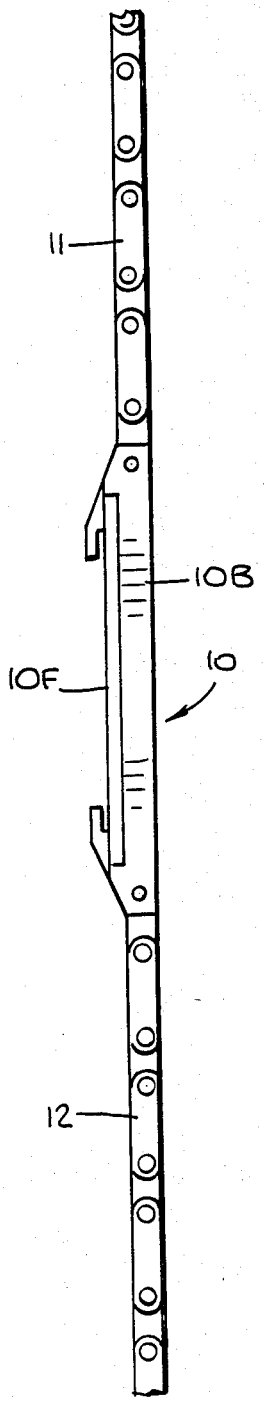
FIG. 2 is a side view of the assembly.

Referring now to FIGS. 1 and 2, there is shown a wrist watch case and bracelet assembly in accordance with the invention. The assembly comprises a bipartite watch case, generally designated by numeral 10, having the two complementary components 11 and 12 of a metal bracelet of the link type pivotally joined at their tail ends to the opposite ends of the case by cross pins 13 and 14. The leading ends of bracelet components 11 and 12 are provided with suitable clasp elements (not shown) which serve to join those components together when they encircle the wrist of the wearer.

Case 10 is constituted by a metal base section 10B in a rectangular frame-like form and a face section 10F of similar geometry which is seated on the base section. Base section 10B, as best seen in FIGS. 3 and 4, is provided with a pair of pierced ears 15 which project forwardly from the corners on one end of this section and a like pair of pierced ears 16 which project forwardly from the corners of the opposite end of the base section.

Figure 3:
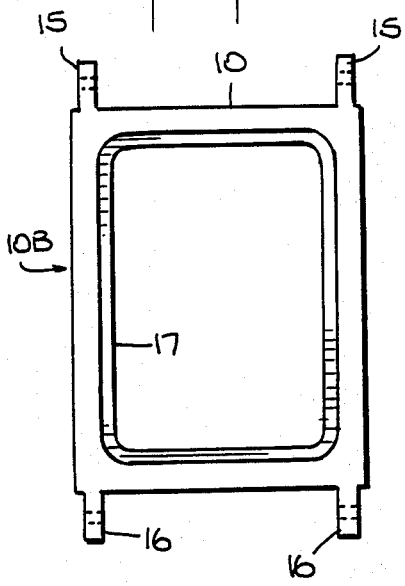
FIG. 3 is a rear view of the base section of the case.
Figure 4:
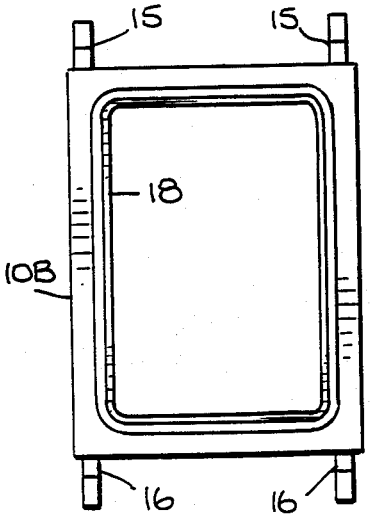
FIG. 4 is a front view of the base section.

As shown in FIG. 3, a generally rectangular well 17 is formed in the rear of base section 10B to snugly accommodate a watch movement (not shown). And, as shown in FIG. 4, the front of the base section is provided with a generally rectangular raised ridge 18 which borders the frame window.

Figure 5:
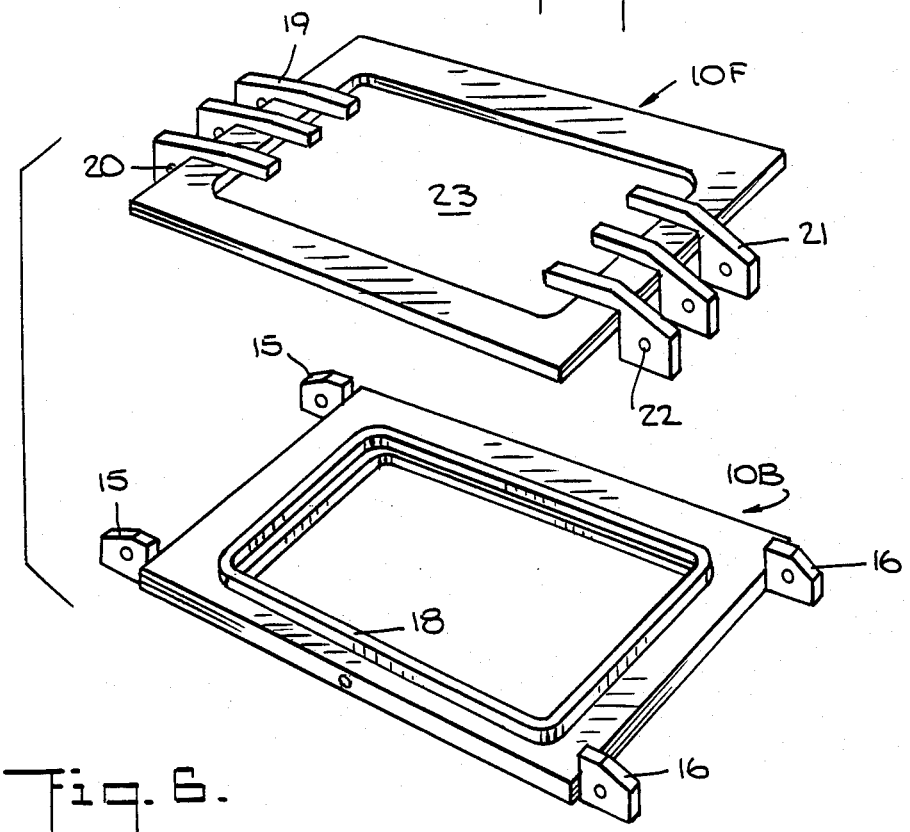
FIG. 5 is an exploded view of the two sections of the case.

Face section 10F, as shown separately in FIG. 5, is provided at one end with an array of equi-spaced projecting lugs 19, each having a hole 20 therein, the opposite end of this section being provided with a like array of lugs 21, each having a hole 22 therein.

The dimensions of the rectangular opening 23 of face section 10F substantially match the outer dimensions of raised ridge 18 on base section 10B, whereby when face section 10F is seated on base section 10B, it is frictionally held thereto and cannot be displaced. When the face section is seated on the base section, holes 20 in lugs 19 of the face section are all in registration with the holes in ears 15 of the base section, and holes 22 in lugs 21 of the face section are all in registration with the holes in ears 16 of the base section.

Figure 6:
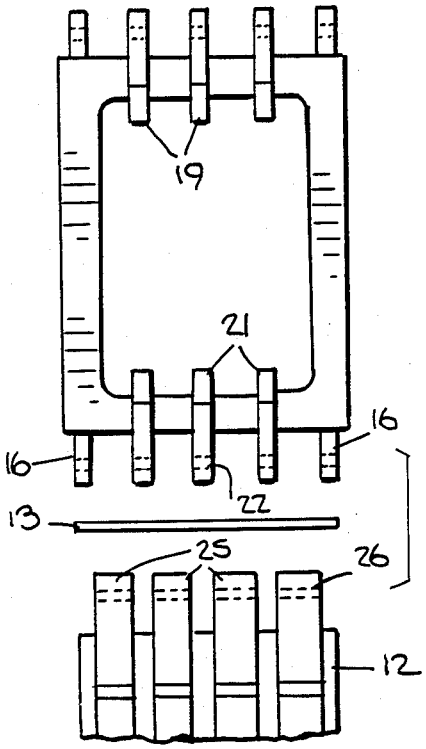
FIG. 6 shows in top view a bracelet component separated from the case and the cross pin for joining the end of this component to the case.

As best seen in FIG. 6, in connection with bracelet component 12, the tail end of this component is formed by an array of four links 25, each having a hole 26 therein. These links intermesh with lugs 21 of face section 10F, holes 26 in links 25 then being in registration with holes 22 in the lugs as well as with the holes in ears 16 of the base section. Hence, when cross pin 13 is inserted to bridge ears 16, this pin passes through the intermeshed bracelet links and the lugs of the face section, and in doing so, the cross pin interlocks the face section to the base section of the watch case, while at the same time pivotally connecting the bracelet component to the end of the watch case.

Figure 7:
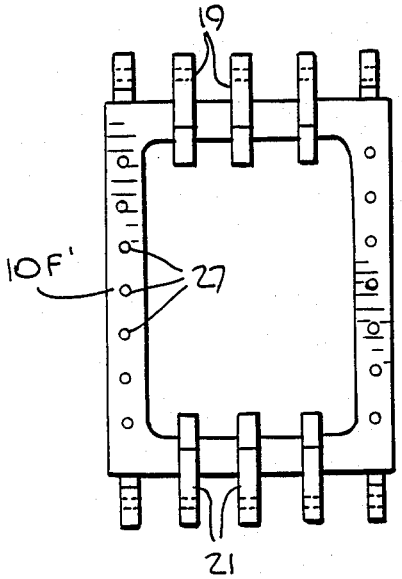
FIG. 7 shows in top view another face section having a different ornamental appearance from that shown in FIG. 5.

Thus, when cross pins 13 and 14 are in place on either side of the watch case, the bracelet components are pivotally coupled to the case, and the watch case sections are interlocked. If now one wishes to replace face section 10F with another face section 10F' of the type shown in FIG. 7, which is the same structurally but is adorned by gems 27 encrusted in the front well thereof or by other ornamental elements, then the procedure is reversed. First, cross pins 13 and 14 are removed to disconnect the bracelet components 11 and 12 from the watch case. Then face section 10F is pried off base section 10B and replaced by face section 10F', and finally the pins are reinserted to interlock the face and base sections of the case and to join the bracelet components thereto.

To give an example of the variations in appearance made possible by the invention, let us assume that the permanent base section of the watch case is of stainless steel. This is desirable because of the strength of the metal and its non-reactive nature with respect to the skin of the wearer which engages the back of the case. If the face section of the watch case is also of stainless steel, then one has a watch having a presentable, conservative appearance, and one, incidentally, not likely to attract muggers.

If now one wishes to impart a more expensive yet conservative look to the watch, one can, in the manner previously described, replace both the stainless steel face section of the case and the stainless steel bracelet with solid gold pieces. And if one then wishes to retain the gold bracelet but replace the unadorned gold face section with a gold face section that is more ornamental, such as that shown in FIG. 7, this can readily be done by again withdrawing the cross pins.

It is not necessary to the invention that the lugs on the face section extend into the frame window, nor is it necessary that the watch case have the rectangular geometry shown, for other geometric shapes can be used. In practice, a purchaser of the watch may be provided with several face sections of different ornamental appearance, and also with bracelets of different ornamental appearance, so that the wearer is then free to exercise his taste in deciding what appearance to impart to the watch, while retaining a high quality watch mechanism.

While there has been shown and described a preferred embodiment of a wrist watch case and bracelet assembly in accordance with the invention, it will be appreciated that many changes and modifications may be made therein without, however, departing from the essential spirit thereof.

I claim:

1. A wrist watch and bracelet assembly comprising:

A a bipartite case composed of a base section adapted to accommodate a watch movement and provided at either end with a pair of pierced ears projecting forwardly from the corners of the base section, and a face section seated on the base section and provided at either end with an array of equi-spaced, forward projecting lugs having holes therein which register with the holes in the ears;

B a bracelet to encircle the wrist of a wearer formed of two components, each having a tail constituted by an array of equi-spaced links which intermesh with the lugs on the related end of the face section, the links having holes therein which register with those in the lugs and the ears;

C a cross pin insertable into the holes of the ears at each end of the case to bridge the ears, the cross pin passing through the holes in the lugs and the links, thereby interlocking the base and face sections of the case and pivotally joining the bracelet components to the ends of the case.

2. An assembly as set forth in claim 1 provided with a plurality of face sections, each having a different ornamental appearance but essentially the same structure, whereby the wearer may readily replace one face section seated on the base section with another to change the appearance of the case.

3. An assembly as set forth in claim 1, wherein said watch case has a rectangular shape and each section thereof has a frame-like configuration.

4. An assembly as set forth in claim 3, wherein said base section has a rectangular well formed in the rear thereof to accommodate said movement.

5. An assembly as set forth in claim 4, wherein said base section has a raised ridge on the front thereof which fits within the opening of the frame-like face section when this section is seated on the base section.

6. An assembly as set forth in claim 1, wherein said base section is of stainless steel.

7. An assembly as set forth in claim 6, wherein said face section is of a metal other than stainless steel.

* * * * *